US007063017B2

(12) United States Patent
Ohigashi et al.

(10) Patent No.: US 7,063,017 B2
(45) Date of Patent: Jun. 20, 2006

(54) PRINTING PLATE AND PLATE MAKING METHOD

(75) Inventors: Chiaki Ohigashi, Kanagawa (JP); Shigeru Iemura, Kanagawa (JP); Masayoshi Miura, Kanagawa (JP); Tsuyoshi Takahashi, Ehime (JP)

(73) Assignees: Panasonic Communications Co., Ltd., Fukuoka (JP); Matsushita Electric Industrial Co., Ltd., Osaka (JP)

( * ) Notice: Subject to any disclaimer, the term of this patent is extended or adjusted under 35 U.S.C. 154(b) by 84 days.

(21) Appl. No.: 10/725,529

(22) Filed: Dec. 3, 2003

(65) Prior Publication Data

US 2004/0118308 A1 Jun. 24, 2004

(30) Foreign Application Priority Data

Dec. 19, 2002 (JP) ..... 2002-367815

(51) Int. Cl.
*B41C 1/10* (2006.01)
*B41N 1/00* (2006.01)

(52) U.S. Cl. ..... 101/463.1; 101/453; 101/466; 430/302

(58) Field of Classification Search ..... 101/453, 101/454, 457, 462, 463.1, 465, 459, 466; 430/302, 300
See application file for complete search history.

(56) References Cited

U.S. PATENT DOCUMENTS 6,143,158 A * 11/2000 Nishino et al. ..... 205/219
6,341,560 B1 * 1/2002 Shah et al. ..... 101/463.1
6,354,209 B1 * 3/2002 Van Aert et al. ..... 101/466
6,373,218 B1 * 4/2002 Takanashi et al. ..... 318/568.21
6,737,218 B1 * 5/2004 Mori ..... 430/271.1
2002/0051931 A1 * 5/2002 Mori et al. ..... 430/270.1
2003/0159607 A1 * 8/2003 Nitzan et al. ..... 101/466
2003/0167950 A1 * 9/2003 Mori ..... 101/453

FOREIGN PATENT DOCUMENTS

EP 0 503 621 A1 * 9/1992
JP 1-212426 8/1989
JP 4-69244 3/1992
JP 06-272097 9/1994
JP 11-256085 9/1999
JP 2001-219527 8/2001
JP 2002-67521 3/2002

OTHER PUBLICATIONS

English Language Abstract JP11-256085.

(Continued)

*Primary Examiner*—Leslie J. Evanisko
(74) *Attorney, Agent, or Firm*—Greenblum & Bernstein, P.L.C.

(57) ABSTRACT

Provided is a printing plate comprising a substrate and a hydrophilic porous layer formed on a surface of the substrate. Typically, the substrate is made of aluminum plate, and the porous substrate consists of an anodized layer. Owing to the porous nature of the surface of the printing plate, the imaging resin deposited on the surface of the printing plate seeps into the printing plate and is thereby securely anchored to the printing plate so that an adequate bonding force between the imaging resin and printing plate can be ensured. Also, by suitably controlling the amount of the imaging resin that seeps or penetrates into the porous layer, an adequate thickness of the imaging resin on the surface of the printing plate can be ensured, and this also contributes to the wear resistance of the printing plate.

29 Claims, 6 Drawing Sheets

OTHER PUBLICATIONS

English Language Abstract JP2001-219527.
English Language Abstract JP04-69244.
English Language Abstract JP2002-67521.
English Language Abstract JP01-212426.
English Language Abstract JP06-272097.

* cited by examiner

PRINTING PLATE AND PLATE MAKING METHOD

TECHNICAL FIELD

The present invention relates to a printing plate having a hydrophilic surface, and a plate making method using such a printing plate.

BACKGROUND OF THE INVENTION

The planographic printing can be carried out by using any one of a number of different types of printing plates. For instance, an imaged forming layer made of photosensitive resin is coated over a substrate, and the desired image portions are formed in the image forming layer by photographically selectively exposing the image forming layer with the aid of an original film placed over the surface of the image forming layer to thereby cure the image portions, and removing the portions of the image forming layer which were not cured. According to another conventional plate making process, an image forming layer made of photosensitive resin is coated over a substrate, and the desired image portions are formed in the image forming layer by selectively radiating an infrared laser beam onto the image forming layer so as to define and selectively cure the image portions on the image forming layer, and removing the portions of the image forming layer which were not cured. According to yet another plate making process, a foaming layer including small particles of thermally foaming material and light absorbing material is interposed between a substrate and an image forming layer, and a desired image is formed in the image forming layer by selectively heating the light absorbing material after a desired pattern and removing the image forming layer by the abrasive action of the thermally foaming material.

It is also known to melt a hot melt ink composition which contains photochemical material and is in solid form at room temperature, expel the molten ink composition from a nozzle in the form of liquid droplets so as to form the desired image on an aluminum plate having an anodized surface layer, and cure the ink composition by the radiation of light (see Japanese patent laid open publication No. 11-256085). According to another method, imaging ink containing a lipophilic component is sprayed from an ink jet recording head so as to form a desired image (see Japanese patent laid open publication No. 2001-219527). According to yet another method, a desired image is formed on a substrate given with a hydrophilic surface by spraying hydrophobic ink containing a light curing component onto the substrate from an ink jet recording head, and the entire surface is exposed to light so that the ink may be cured on the surface of the substrate (see Japanese patent laid open publication No. 4-69244).

According to such known methods of preparing planographic printing plates using an ink jet recording head, as no photographic developing step is required for the removal of the portions of the photosensitive resin which did not cure, the problems associated with the photographic process such as the costs and labor that are required in maintaining the developer and disposing the used developer can be avoided. Also, as no expensive equipment such as a high output infrared laser is required, the associated problems such as the high cost of the laser can be avoided. Also, the blank printing plates for such methods are highly simple and economical.

In a conventional printing plate having a photosensitive resin layer (regular PS plates and PS plates for dry CTP), the surface of an aluminum base plate may be subjected to an anodic oxidation for the purpose of improving the wear resistance of the printing plate and the photosensitive resin layer may be formed on the anodized surface. However, when a photosensitive layer is to be formed, it is necessary to seal the anodized layer by using hydrophilic material and thereby prevent the photosensitive material from seeping into the small pits of the anodized layer. Otherwise, the photosensitive material would seep into the small pits of the anodized layer, and get lodged therein so that the photosensitive material that has not cured and is required to be removed would fail to be removed cleanly off the printing plate. This is obviously undesirable.

In case of the plate making process using an ink jet recording head for spraying a hot melt ink composition proposed in Japanese patent laid open publication No. 11-256085, as there is a need to melt the ink composition which is in solid form at room temperature, a heating arrangement is necessary to keep the feeding unit and ink jet recording head warm, and this adds to the complexity of the system. Also, because the hot melt ink composition is so small in volume, the ink composition rapidly solidifies as soon as it reaches the printing plate having a relatively large heat capacity, and the bonding force between the printing plate and ink composition is undesirably weak. Furthermore, the surface of the conventional printing plate is sealed for the purpose of making the entire surface hydrophilic, and the ink composition is not able to penetrate into the surface layer of the printing plate. This also prevents the bonding force between the printing plate and ink composition from increasing to a desired degree.

In case of the plate making process proposed in Japanese patent laid open publication No. 2001-219527, the image portions which may consist of dots or lines tend to lack in thickness so that the produced printing plate may not be suited to make a large number of prints.

In case of the plate making process proposed in Japanese patent laid open publication No.4-69244, it is advantageous to be able to use common substrate material such as conventional PS plates, but the imaging resin deposited on the surface of the substrate tends to spread out so much that it is difficult to achieve a plate making process at a high resolution. Furthermore, the bonding force between the imaging resin and substrate is limited, and the produced printing plate is therefore not suited for making a large number of prints.

The conventional PS plate is produced by forming an anodized film over the coarsened surface of an aluminum base plate, making the surface hydrophilic and applying a layer of photosensitive resin material over the hydrophilic surface. The surface of the aluminum base plate is made both coarse and hydrophilic typically by sand blasting, electrolytic polishing, anodic oxidation and dipping into soda silicate (also for sealing the pits that may be present on the surface of the substrate). The PS plate is not provided with a porous layer that may help a suitable amount of the imaging resin to be retained on the surface because such a porous layer would prevent the photosensitive material from being etched away during the developing process. In Japanese patent laid open publication 2002-67521, it is discussed that the deep grooves produced as a surface coarsening process may cause small patches of the photosensitive material to be left on the surface of the printing plate.

In short, none of the conventional printing plates mentioned above can provide all of the desired attributes of a printing plate such as printing suitability (satisfactory deposition of ink on the image portions and resistance to soiling of the non-image portions), wear resistance (capability to make a large number of prints), a long shelf life and a high image resolution.

During the course of investigating the problems associated with the prior art, the inventors have discovered that the surface property of the printing plate is highly important in achieving the desired attributes of a printing plate. In particular, it was discovered that providing a certain porosity to the surface of the printing plate allows the desired attributes of a printing plate to be achieved.

BRIEF SUMMARY OF THE INVENTION

In view of such problems of the prior art and the discoveries made by the inventors, the present invention provides a printing plate, comprising: a substrate; and a hydrophilic porous layer formed on a surface of said substrate as well as a method for making a printing plate, comprising the steps of: preparing a blank printing plate including a substrate and a hydrophilic porous layer formed on a surface of said substrate; applying imaging resin in a substantially liquid form on selected parts of the surface of said porous layer; and curing said imaging resin applied to said porous layer.

Owing to the porous nature of the surface of the printing plate, the imaging resin deposited on the surface of the printing plate seeps into the printing plate and is thereby securely anchored to the printing plate so that an adequate bonding force between the imaging resin and printing plate can be ensured. This contributes to an improved durability and extended shelf life of the printing plate. Also, by suitably controlling the amount of the imaging resin that seeps or penetrates into the porous layer, an adequate thickness of the imaging resin on the surface of the printing plate can be ensured, and this also contributes to the wear resistance of the printing plate (capability to make a large number of prints). In particular, by suitably controlling the average diameter, average depth and/or density of the pits that are present in the porous layer, it is possible to achieve a high resolution and wear resistance.

Also, according to the plate making method of the present invention, because the plate making process is highly simple to carry out and requires highly simple hardware, a plate making unit for implementing such a plate making process can be easily incorporated into a printing machine.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
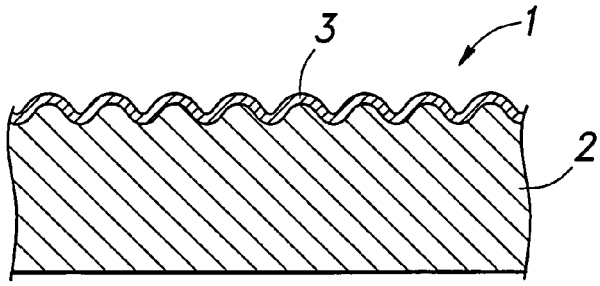
FIG. 1 is a simplified sectional view showing the structure of a printing plate given as a first embodiment of the present invention.

"Resin" or "imaging resin" as used in this application means materials in general that can be applied to a printing plate of the present invention by using an ink jet recording head or other devices for applying material after a prescribed pattern. "Ink" or "printing oil ink" means liquid material that can be used in printing machines for printing purposes using a printing plate according to the present invention.

The imaging resin typically consists of ultraviolet curing resin that is also used as common printing oil ink, and comprises high viscosity oligomer, low viscosity oligomer and/or monomer (reactive diluent), photochemical polymerization initiator and pigments. The reactive diluent is used for adjusting the viscosity of the resin, and essentially consists of oligomer having a relatively high viscosity, high boiling point monomers and low viscosity polyester acrylate. Typical oligomers include polyester acrylate, epoxy acrylate and urethane acrylate. The photochemical polymerization initiator generates radicals when radiated by ultraviolet energy, and initiates polymerization by reacting with reactive groups of the monomers and oligomers.

For such ultraviolet curing resin to be used as an imaging resin for the present invention, it is required to have a relatively low viscosity as compared with common printing oil ink so as to be smoothly expelled from an ink jet recording head. The resin is required to have a viscosity of no more than 60 cps, more preferably no more than 30 cps, for the resin to be expelled from an ink jet recording head in the form of droplets in a stable manner. Common printing oil ink contains pigments, but the imaging resin used in the present invention is not required to be tinted as long as it remains lipophilic when cured. If the imaging resin is tinted by pigment or other tinting agent, the inspection of the image on the prepared printing plate is facilitated.

The structure of the printing plate is described in the following. The printing plate for use in the present invention is required to have two attributes. One is the suitability for printing. The hydrophilic portions are required to be able to retain moisture in a stable manner while the lipophilic portions are required to retain printing oil ink in a stable manner. The other is the suitability for high resolution. The high resolution dots consisting of resin particles (portions where the imaging resin is deposited) are required to be formed in a stable manner.

A few more remarks on the suitability for printing may be appropriate in this conjunction. In the printing plate of the present invention, it is desirable to have a certain tolerance in the amount of the moisture that can wet the hydrophilic portions on the surface in a satisfactory manner. In other words, it is not desirable if slight fluctuations in the amount of the moisture that wets the hydrophilic portions should cause dry portions to be produced on the hydrophilic portions or cause moisture to invade the lipophilic portions because an unacceptably rigorous control of the amount of the moisture would become necessary. To achieve such a tolerance, surface irregularities on the surface of the printing plate are controlled as described in the following. Macroscopic waves (in the order of 100 μm in wavelength, for instance) are formed on the surface of the material (aluminum) of the printing plate, as is the case with the conventional PS printing plate, to allow excess moisture to be retained in the dips of these waves. Additionally, the surface is formed with intermediate waves (in the order of 10 μm in wavelength, for instance) to retain moisture in the dips so that no dry portion may be produced even when the amount of the moisture is slightly short. Finally, a hard layer is formed on the surface by an anodic oxidation process for the purpose of increasing the durability of the printing plate, causing microscopic waves to be formed on the surface at the same time. The hard layer formed by anodic oxidation is porous by including numerous small pits. Conventionally, such pits were filled by hydrophilic material as can be seen in conventional PS printing plates because, otherwise, the photosensitive resin would seep into such pits and it would prevent the removal of the excess parts of the photosensitive resin.

A few more remarks on the suitability for high resolution would be appropriate in this conjunction. In the printing plate of the present invention, it is necessary for the desired high resolution to be achieved that the porous surface layer is capable of absorbing and retaining the imaging resin deposited on the surface. Such an action owing to the presence of the porous layer was absent in the conventional PS printing plate which is subjected to the process of filling the pits on the surface (sealing) following the process of making the surface hydrophilic by forming the macroscopic, intermediate and microscopic waves. More specifically, the porous surface layer of the printing plate of the present invention may be similar to the irregular surface of the conventional PS printing plate subjected to the pit filling process, but differs therefrom in that the layer has a substantially greater thickness and provided with pits extending substantially deeper into the layer in relation to the diameter of the pits. The pits that may be present on the surface of the conventional PS printing plate are not deep enough as compared with their width, and significantly different from the pits that can be found in the porous layer of the printing plate of the present invention.

The optimum values of the depth and diameter of the pits on the surface of the printing plate of the present invention in forming optimum resin dots vary depending on the size of the dots that are to be formed, but are desired to be such that the diameter of the dots is sufficiently smaller than the dot diameter, and the depth of the pits (or the thickness of the porous layer) is at least twice the diameter or more, preferably no less than five times the diameter. A porous layer formed in this fashion is also capable of forming high resolution dots by preventing the spreading of the deposited resin particles, and retaining relatively large amounts of moisture.

FIG. 1 is a simplified sectional view showing the structure of a blank printing plate 1 for forming the printing plate embodying the present invention. As shown in the drawing, the blank printing plate 1 comprises an aluminum base plate 2, and a hydrophilic porous layer 3 formed on the surface of the base plate 2. The porous layer 3 is formed by degreasing the surface of the aluminum base plate 2, removing oil and oxide film from the surface by etching, coarsening the surface by electrolytic polishing and/or sand blasting and forming oxide layer which is both porous and wear resistant by anodic oxidation (making the surface hydrophilic at the same time). It is also possible to additionally coat a hydrophilic layer made of such materials as $SiO_2$ on the surface of the porous layer 3 to positively make the surface hydrophilic.

Figure 2:
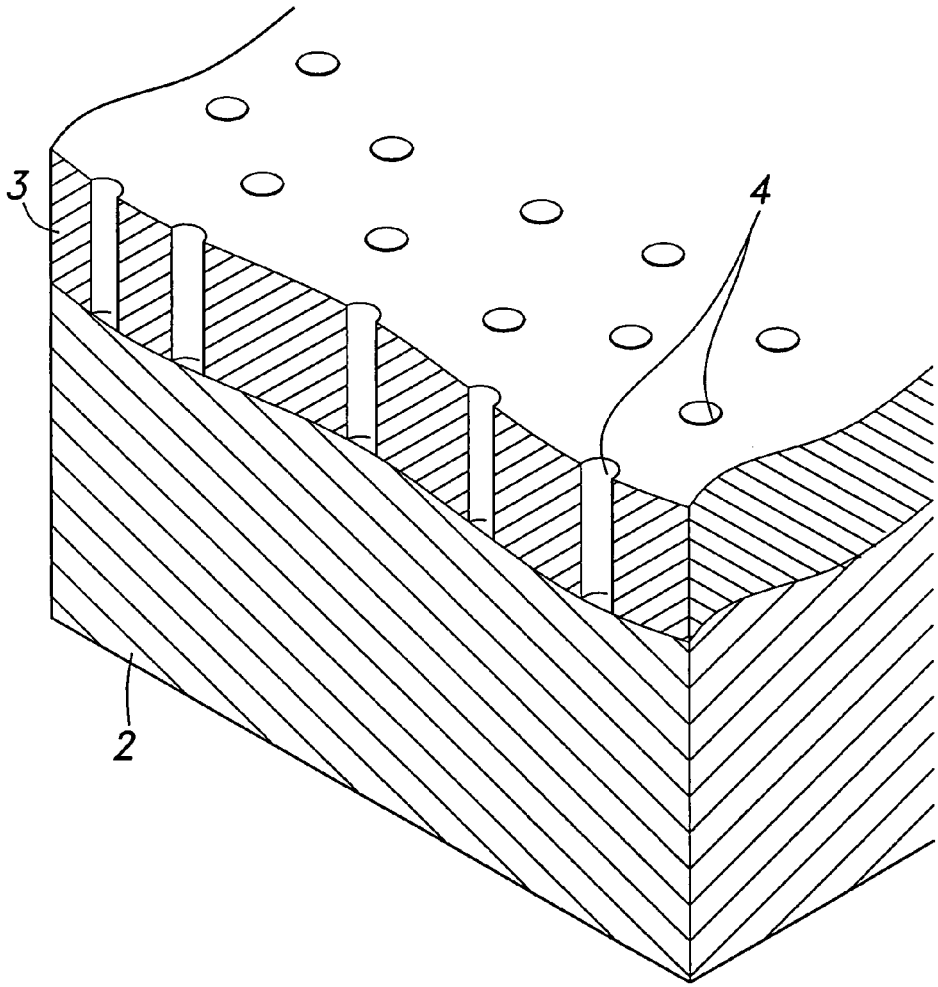
FIG. 2 is a fragmentary perspective view partly in section showing the details of the hydrophilic porous layer of the printing plate illustrated in FIG. 1.

FIG. 2 shows the detailed structure of the hydrophilic layer of the printing plate illustrated in FIG. 1. As shown in the drawings, the hydrophilic porous layer 3 is provided with numerous pits 4. As will be discussed hereinafter, lipophilic imaging resin is deposited on the surface of the porous layer 3 after the desired image to be formed. To ensure the printing suitability of the printing plate, the bonding force between the porous surface 3 and deposited imaging resin is required to be adequately strong and the deposited printing resin is provided with a suitable thickness (preferably to the height of 2 to 5 μm as measured from the surface of the porous layer 3). For this purpose, part of the imaging resin should penetrate into the pits 4 to thereby anchor the resin onto the porous layer 3 and the amount of the deposited resin should be such that the required thickness of the imaging resin is achieved on the surface in spite of the loss of the resin due to the infiltration into the pits 4.

As well known in the art, the oxidized layer that is formed by an anodic oxidation process is both hard and porous on account of the presence of numerous pits (having a diameter in the range of about 0.03 to 0.1 μm). Such an oxidized layer formed to the thickness of about 0.1 μm or more is suitable as the porous layer of the printing plate according to the present invention. The imaging resin expelled from an ink jet recording head can penetrate into the pits formed as a result of the anodic oxidation process and form the desired images at a high resolution without spreading laterally. The pits of the porous layer formed by the anodic oxidation can be made substantially smaller in diameter than those formed by electrochemical etching described hereinafter, and are therefore more suitable for forming high resolution images.

An electrochemical etching process may also be used as an alternate method for forming the porous layer 3 for the present invention. An electrochemical etching process is typically conducted in an acid or alkaline water solution, and can be implemented in various different ways. To form the porous layer 3 of the present invention, numerous pits are required to be formed to the required depth by electrochemical etching without excessively dissolving the surface. The etching process and voltage waveforms that are used in the process of making electrode foil for electrolytic capacitors disclosed in Japanese patent laid open publication Nos. 1-212426 and 6-272097 can be used for forming such numerous small pits at high density according to the present invention.

To form image patterns on the printing plate at a high resolution and achieve a high resolution printing, the imaging resin is required to penetrate into the porous layer. For this purpose, the volume of each resin particle that is deposited on the surface of the porous layer 3 should be 2 to 3 pl (pico liter), and the dot size (equivalent diameter of the contact area between the resin particle and the surface of the porous layer 3) should be in the order of 30 μm. The diameter of the pits 4 in the porous layer 3 should be smaller than the dot that is to be formed by the imaging resin, and preferably no more than one tenth of the dot. Therefore, to achieve the required bonding force between the surface of the porous layer 3 and the imaging resin and the required thickness of the imaging resin, numerous pits 4 having diameters in the range of 0.1 to 1 μm and depths in the range of 5 to 10 μm are formed in the porous layer 3 by an electrochemical etching process similar to that of the method for making electrode foil for electrolytic capacitors. The average spacing between adjacent pits should be adequately smaller as compared to the typical size of the imaging resin dots, and should be in the order of 2 to 3 μm to allow the imaging resin to infiltrate into the pits.

When the size of the dot formed by the imaging resin is in the order of 30 μm (preferably at least 10 μm), the resin can be retained by the porous layer while maintaining a circular shape without being affected by the shape of the pits into which the resin penetrates. In this embodiment, an anodic oxidation process is not necessary, but may also be added primarily for the purpose of forming a hard layer and increasing the wear resistance of the printing plate. In such a case, the anodic oxidation forms thin film (oxide layer) on the inner wall surface of each pit (having a diameter in the range of 0.1 to 1 μm) formed by electrochemically etching the surface of the aluminum material without filling the pits of the porous layer. The film formed by the anodic oxidation is highly active and absorbs gases and moisture of the air. Therefore, a hydrophilic material may be coated on the surface of the oxide layer before its property changes. Such a hydrophilic material layer is required to be extremely thin so that the pits may not be closed or filled up.

Particles of imaging resin consisting of acrylic ultraviolet curing resin were experimentally deposited on various aluminum base plates. The first base plate consisted of a PS plate made by Company A, and the second base plate consisted of a PS plate made by Company B. In both cases, the photosensitive layer of the PS plate was removed. The third base plate consisted of an aluminum plate having a porous layer formed thereon by anodic oxidation, and the fourth base plate consisted of an aluminum plate having a porous layer formed thereon by electrochemical etching. The measurements were made of the width of the dots formed by resin droplets (8 to 10 pl) expelled from an ink jet recording head and impinged onto each of these aluminum base plates, and curing the deposited resin by ultraviolet radiation.

TABLE 1

| base plate | dot diameter (μm) |
|---|---|
| #1 | 133 |
| #2 | 84 |
| #3 | 30 |
| #4 | 37 |

As demonstrated in Table 1, in the cases of the first and second base plates, the imaging resin consisting of ultraviolet curing resin that was deposited on the surface of the base plate spread relatively widely. On the other hand, in the cases of the third and fourth base plates based on the present invention, the imaging resin that was deposited on the surface of the base plate formed as relatively small dots, and it means that the base plate is suited for producing a high resolution printing plate. When the surface of the base plate was rubbed with cloth, the deposited and cured imaging resin peeled off relatively easily in the cases of the first and second base plates, but remained firmly attached to the base plate in the cases of the third and fourth base plates. Thus, it was demonstrated that the porous layer according to the present invention provides a strong bonding force between the resin and base plate as well as a high wear resistance. The strong bonding force owes to the anchoring action of the ultraviolet cured resin that has penetrated deep into the pits of the porous layer.

The printing plate may cease to produce images of a desired quality when the surface is soiled and the hydrophilic portions have turned lipophilic. In the printing plate provided with a porous layer according to the present invention, because the parts having no imaging resin deposited thereon are hydrophilic (non-image parts), the printing oil ink may invade the hydrophilic portions and soil the surface of the printing plate only when the hydrophilic portions are dry from the lack of the wetting moisture, but is repelled by the hydrophilic portions as long as the wetting moisture is abundant and covers the hydrophilic portions. The hydrophilic portions may be prevented from drying by reducing the diameter of the pits in the porous layer. More specifically, the particles of the printing oil ink used for offset printing is relatively large in diameter (normally 0.5 μm to 2 μm) so that the printing oil ink would not penetrate into the pits of the hydrophilic portions or soil the surface of the printing plate as long as the diameter of the pits of the porous layer is kept relatively small (less than 0.05 μm, for instance). In other words, by making the diameter of the pits of the porous layer smaller than the particle diameter of the printing oil ink, the printing oil ink is prevented from soiling the surface of the printing plate. In this case, the diameter of the pits of the porous layer should be at least larger than the molecular size of the imaging resin so that the imaging resin may be able to penetrate into the pits.

Anodic oxidation and electrochemical etching can be conducted in various different ways, and the porous layer can have so many different structures. Depending on the particular different processing mode, the pits may extend perpendicularly to the surface of the base plate (which may be referred to as vertical pits), in parallel with the surface of the base plate (which may be referred to as lateral pits) or in random directions. How the imaging resin expelled from the ink jet recording head deposits on the surface of the porous surface and penetrates into the pits very much depends on the structure of the porous layer. In case the pits extend in random directions, the imaging resin deposited on the surface penetrates into the pits in various different directions so that the part of the imaging ink that forms a dot on the surface extends into the porous layer in a semispherical pattern. When the porous layer is formed with vertical pits, because the imaging resin penetrates into the porous layer vertically into the thickness of the porous layer without spreading laterally, a dot having a smaller diameter can be formed as compared with the case where the pits extend in random directions or lateral directions. Therefore, a porous layer formed with vertical pits is considered to be advantageous in producing a high resolution printing plate.

As discussed earlier, the ultraviolet curing resin that is used as the imaging resin of the present invention typically consists of a mixture of a plurality of kinds of oligomers and pigments, and therefore contain substances having a wide range of molecular sizes or particle sizes. When this imaging resin penetrates into a porous layer, the components having relatively smaller molecular sizes or smaller particle sizes penetrate faster than those having relatively larger molecular sizes or larger particle sizes. Therefore, when the porous layer is formed with lateral pits, the components having relatively smaller molecular sizes or smaller particle sizes spread to the periphery of the dot while those having relatively larger molecular sizes or larger particle sizes remain in the central part of the dot. For instance, the particle sizes of the pigments are generally greater than those of reactive diluents and oligomers so that the pigments tend to concentrate in the central part of the dot, and the peripheral part may not be tinted or colored to a desired extent. Such a problem can be avoided by using a base plate having a porous layer formed with vertical pits. In such a case, because the penetration of the imaging resin into the porous layer progresses vertically, there will be no separation of the different components of the imaging resin on the surface.

In forming a porous layer on an aluminum base plate by the anodic oxidation process, any one of phosphoric acid, sulfuric acid and oxalic acid can be used, and the film formed by using such acids may be called as phosphoric acid anodic coating, sulfuric acid anodic coating and oxalic acid anodic coating, respectively. The pits in such anodic coating are provided with diameters in the range of 0.03 to 0.1 μm, and are $10\times10^6$ to $100\times10^6/mm^2$ in number. In the case of the pits that are formed by electrochemical etching in making electrode foil for electrolytic capacitors, the diameters are in the range of 0.1 to 1 μm, and there are about $1\times10^6$ pits per $mm^2$.

Any of such porous layers can be applied to the printing plate according to the present invention, but the depth of the pits (the thickness of the porous layer) is required to be appropriately selected depending on the pit diameter and the number of pits. The capability of a porous layer to retain imaging resin is determined by the pit diameter, number of pits and pit depth. Therefore, once the amount of the imaging resin that is to be expelled from the ink jet recording head is determined, the pit diameter, number of pits and pit depth can be appropriately selected so that the printing plate may be given with a capability to retain imaging resin that matches with the amount of the imaging resin expelled from the ink jet recording head.

Because part of the deposited imaging resin fills into the pits of the hydrophilic porous layer and cures therein, the bonding force between the surface of the printing plate and imaging resin is substantially stronger as compared with the case where the imaging resin is deposited on the surface of a printing plate having closed pits and cures on the surface, so that the wear resistance and shelf life of the printing plate can be substantially improved. By forming a hydrophilic porous layer having an appropriately selected average pit spacing and average pit depth, the imaging resin that fills into the pits increases the bonding force between the imaging resin and printing plate while a suitable amount of printing resin is deposited on the surface of the printing plate so that the printing plate having a favorable print quality can be achieved in spite of the simplicity of the structure thereof. The average spacing between adjacent pits is sufficiently smaller than the representative dimension of the deposited imaging resin dot so that the deposited imaging resin penetrates into the pits without fail, and the imaging resin that has penetrated into the pits provides an anchoring action for the deposited imaging resin even when the print pattern consists of small dots and fine lines. An adequate amount of imaging resin remains on the surface so that the imaging ink is deposited and retained on the surface of the printing plate as bulging dots. If the pits in the portions of the surface where the imaging ink is absent are too deep, the moisture that is applied to the surface of the printing plate during printing may be absorbed so much into the pits that the surface of the printing plate may fail to be properly wetted by the moisture. However, if the average depth of the pits is selected to be 5 μm to 10 μm, the surface level of the moisture can be raised to the surface of the printing plate, and the hydrophilicity of the surface of the printing plate can be ensured by adequately moisturizing the surface.

Figure 3:
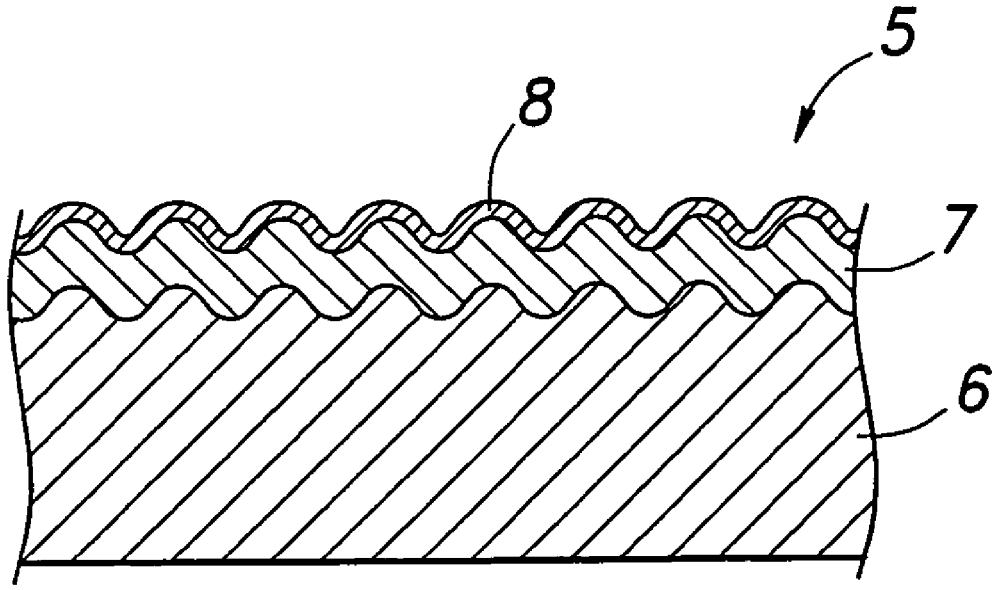
FIG. 3 is a view similar to FIG. 1 showing a second embodiment of the present invention.

FIG. 3 is a simplified sectional view of a blank printing plate 5 given as a second embodiment of the present invention. The blank printing plate 5 comprises a base film 6 made of resin material such as PET, aluminum film 7 formed on the surface of the base film 6 by vapor deposition, and a hydrophilic porous layer 8 formed on the surface of the aluminum film 7 by electrolytically polishing the surface of the aluminum film 7 and performing an anodic oxidation process or electrochemical etching. The base film 6 may also consist of water-proof synthetic paper instead of the resin film. This embodiment reduces the amount of the aluminum used in the printing plate, and allows the hydrophilic porous layer to be formed as a highly simple structure.

Figure 4A:
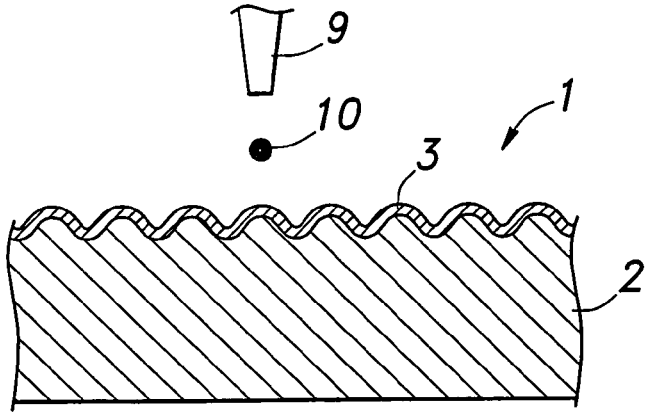
FIGS. 4*a* to 4*c* are sectional views showing the various steps of a plate making process using the printing plate illustrated in FIG. 1.
Figure 4B:
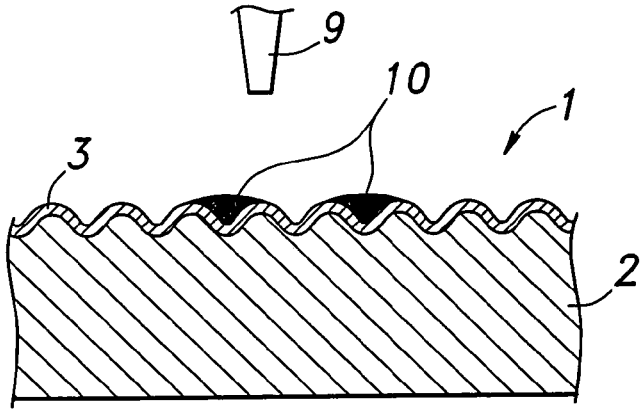
Figure 4C:
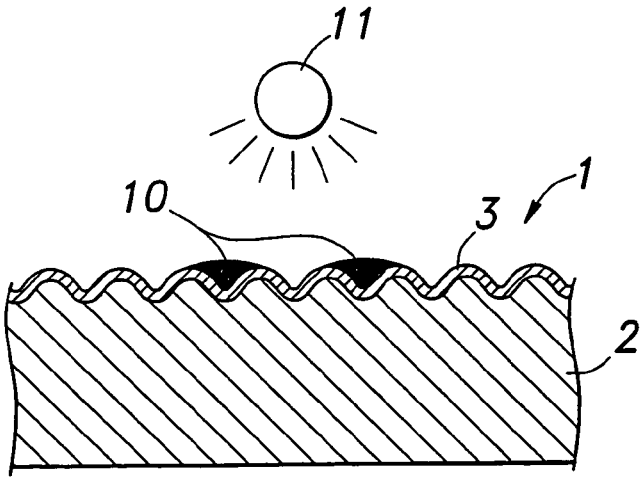

FIGS. 4*a* to 4*c* show various steps of making a printing plate by using a blank printing plate illustrated in FIG. 1. Referring to FIG. 4*a*, Ultraviolet curing resin or imaging resin 10 in the form of fine droplets are blown against the blank printing plate 1 by using a nozzle 9 after a desired image pattern. The volume of each droplet of the ultraviolet curing resin 10 expelled from the nozzle 9 is preferably 2 to 3 pl to enable a high resolution image pattern to be formed as mentioned earlier. The imaging resin 10 is required to have a relatively low viscosity to form highly fine droplets at high speed (5 kHz or higher), and is desired to be 30 cp or lower at room temperature. More specifically, by controlling the viscosity of the imaging resin to be 30 cp or lower, the imaging resin may be made fluidic enough to be expelled from the nozzle in a desired manner (without creating such problems as blocking the nozzle orifice and failing to form droplets having a size within a desired range when expelled at high speed). The same process may also be applied to the blank printing plate 5 illustrated in FIG. 3.

Referring to FIG. 4*b*, part of the imaging resin 10 deposited on the blank printing plate 1 seeps into the hydrophilic porous layer 3 while the remaining imaging resin 10 remains on the surface of the blank printing plate 1 in the form of a blob or a plump lump. For the imaging resin 10 to stay on the surface of the blank printing plate 1 maintaining a desired thickness without flowing over the surface, the viscosity thereof should be 5 cp or higher. By controlling the viscosity of the imaging resin to be 5 cp or higher, the fluidity of the imaging resin deposited on the surface of the blank printing plate can be made low enough to take a desired configuration (without flowing over the surface of the blank printing plate).

Finally, referring to FIG. 4*c*, ultraviolet light 11 is radiated upon the blank printing plate 1 to cure the imaging resin 10 which has seeped into the pits of the porous layer 3 as well as that deposited on the surface of the blank printing plate 1. Thereby, the surface of the printing plate 1 is patterned so as to include lipophilic portions where the cured ultraviolet curing resin 10 is present and hydrophilic portions where the porous layer 3 is exposed. The imaging resin 10 consisted of ultraviolet curing resin which is in liquid form at room temperature in the foregoing embodiment, but may also consist of other types of resin such as thermosetting resin which is in liquid form at room temperature and cures by heat, for instance, applied by a heat source such as a halogen lamp.

The process of preparing a printing plate consists of only two steps, deposition of imaging resin and curing of the same, and is therefore highly simple. In particular, because the imaging resin is in liquid form at room temperature, no heating device is required.

Preferably, the content of the solvent in the imaging resin 10 is 10 weight % or less so that the change of the volume of the resin as a result of the evaporation of the solvent during the curing process may be minimized, and the image may be formed at a high resolution without distortion. By thus minimizing the volume change of the imaging resin, the imaging resin deposited on the printing plate can maintain the desired rounded shape during the curing process, and a desired printing result can be ensured without the imaging resin becoming excessively thin.

Figure 5A:
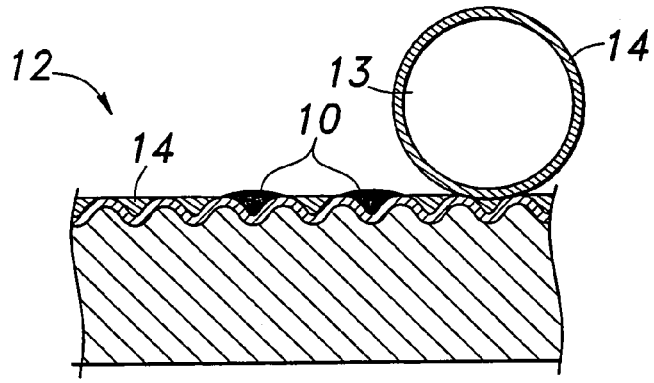
FIGS. 5*a* to 5*d* are sectional views showing the various steps of a printing process using the printing plate by using the plate making process illustrated in FIGS. 4*a* to 4*c;*

FIGS. 5*a* to 5*d* show a printing process using the printing plate 12 (having the imaging resin deposited thereon after the desired pattern) prepared by the process illustrated in FIGS. 4*a* to 4*c*. Referring to FIG. 5*a*, a wetting roller 13 containing wetting moisture 14 is applied onto the printing plate 12 while it is turned to adhere the wetting moisture 14 onto the exposed hydrophilic surface of the porous layer 3 (non-image portions) having no imaging resin 10 deposited thereon. The portions where the imaging resin 10 is deposited (image portions) repel the wetting moisture 14.

Figure 5B:
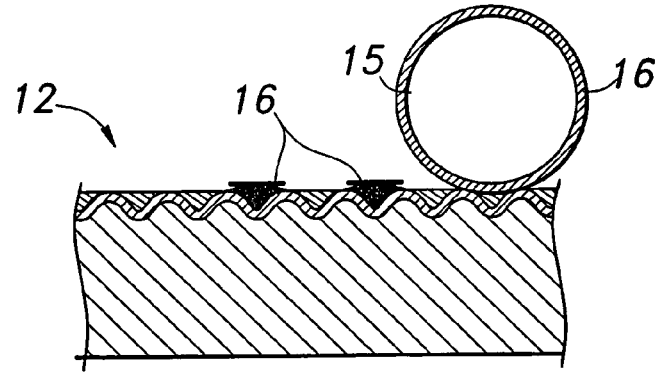

Referring to FIG. 5*b*, an inking roller 15 having printing oil ink 16 deposited on the surface thereof as a thin layer is pressed against the printing plate 12 while it is turned. The non-image portions which are wetted by the wetting moisture repel the printing oil ink 16 so that the printing oil ink 16 is deposited preferentially onto the image portions-where the lipophilic imaging resin 10 is applied.

Figure 5C:
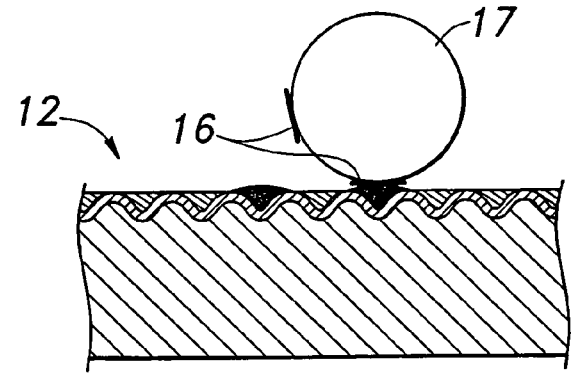

Referring to FIG. 5*c*, an intermediate transfer roller which is called as a blanket roller 17 made of elastomeric resilient material is pressed against the printing plate 12 while it is turned so that the printing oil ink 16 deposited on the imaging resin 10 is transferred onto the blanket roller 17.

Figure 5D:
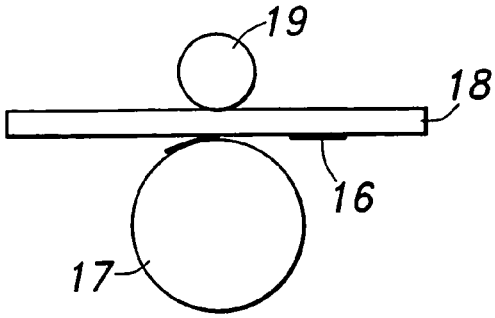

Finally, referring to FIG. 5*d*, the blanket roller 17 is pressed against a sheet of printing paper 18 or the like supported by a pressure roller 19, and the paper 18 is passed through the nip between the two rotating rollers 17 and 19 so that the printing oil ink 16 is transferred onto the paper 18 and a desired printing is achieved.

Because the image formed by the ink on the printing plate is transferred onto the blanket roller, and then onto the printing paper, the printing plate is protected from damages that might be caused by the direct contact with the printing paper. In other words, because the printing plate and the pressure roller supporting the printing paper from the back are both substantially rigid members, if they were used directly for printing without the intervention of the blanket roller, they would be required to have an unacceptably high level of planarity for the printing oil ink to be completely transferred onto the printing paper for the different colors to be faithfully reproduced and localized dropouts to be avoided.

Figure 6:
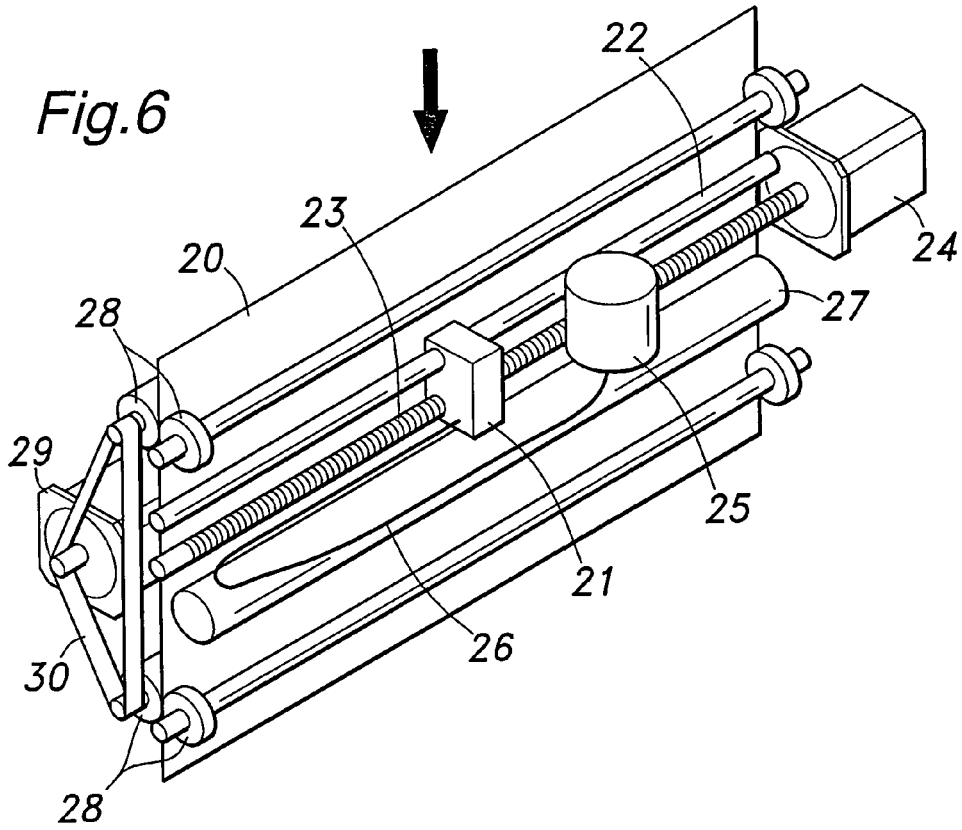
FIG. 6 is a simplified perspective view of a plate making machine suitable for implementing the plate making process illustrated in FIGS. 4*a* to 4*c;*

FIG. 6 is a simplified view of a plate making machine for implementing the plate making process illustrated in FIGS. 4*a* to 4*c*. The illustrated plate making machine comprises a recording head 21 having one or a plurality of nozzles for blowing fine liquid droplets of imaging resin against the printing plate 20, a guide rod 22 for guiding the lateral movement of the head 21, a screw rod 23 for actuating the head 21 along the guide rod 22, an electric motor 24 for turning the screw rod 23, a resin tank 25 containing the imaging resin, a tube 26 for feeding the resin from the resin tank 25 to the recording head 21, an ultraviolet lamp 27 for curing the imaging resin deposited on the printing plate 20, conveyor rollers 28 for transporting the printing plate 20, an electric motor 29 for driving the conveyor rollers 28, and a drive belt 30 for transmitting the power from the electric motor 29 to the conveyor rollers 28. The recording head 21 may also consist of a system other than an ink jet recording head as long as the imaging resin may be sprayed in the form of fine liquid particles in a controllable manner, but the use of the existing ink jet recording head for printing purposes allows the manufacturing and maintenance costs to be minimized.

When the printing plate carrying the imaging resin thereon reaches the station where the ultraviolet lamp 27 is placed, the lamp 27 is lighted, and ultraviolet light is radiated upon the printing plate 20 to cure the imaging resin deposited on the printing plate to define the desired image. When this curing step is completed, the printing plate is finished and ready to be mounted on a common rotary printer and print a desired number of sheets of paper.

Figure 7:
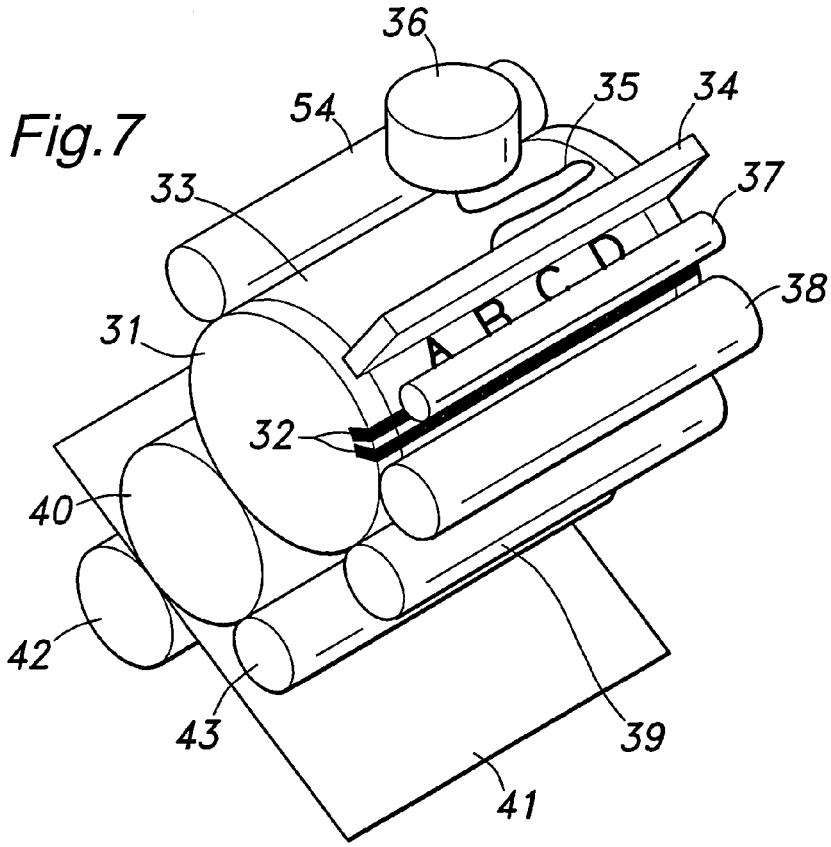
FIG. 7 is a simplified perspective view showing a printing machine for both on press plate making and printing according to the present invention.

FIG. 7 is a simplified view of a printing machine which is capable making printing plates on press or on the printing machine. To add the plate making feature to this printing machine, the printing machine is provided with a cylinder 31 for mounting a blank printing plate 33 such as those illustrated in FIGS. 1 and 3, a clamp unit 32 for securing the printing plate 33 on the cylinder 31, a recording head 34 having a large number of nozzles arranged along the axial direction of the cylinder 31 to blow fine liquid droplets of imaging resin against the printing plate 33, a resin tank 36 containing the imaging resin, a tube 35 for feeding the resin from the resin tank 36 to the recording head 34 and an ultraviolet lamp 37 for curing the imaging resin deposited on the printing plate 33, in addition to such regular components of a printing machine as a wetting roller 38 for preferentially wetting the non-image portions of the printing plate 33 with wetting moisture, an inking roller 39 for preferentially depositing printing oil ink onto the image portions of the printing plate 33, a blanket roller 40 for transferring the image formed on the printing plate 33 by the printing oil ink thereon, and a pressure roller 42 for supporting a sheet of printing paper 41 or the like when pressing the blanket roller 40 onto the printing paper 41 to transfer the image on the blanket roller 40 onto the printing paper 41.

In this printing machine, when a blank printing plate 33 has been secured to the cylinder 31 with the clamp unit 32, the printing machine is put to the "plate making" mode, and the recording head 34 and ultraviolet lamp 37 are set ready for operation. In the "plate making" mode, the recording head 34 is controlled by a digital signal representing a raster image for each page, and imaging resin consisting of ultraviolet curing resin is expelled from the recording head 34 in synchronism with the rotation of the cylinder 31 to be deposited on the printing plate 33. As a result, the surface of the printing plate 33 is provided with image portions where the lipophilic imaging resin is present and non-image portions where the imaging resin is absent and the hydrophilic porous layer is exposed. Ultraviolet light is then radiated upon the printing plate 33 to cure the imaging resin on the image portions.

In this printing machine, a printing plate can be prepared while the printing plate is mounted on the cylinder 31, and becomes ready for printing while it is kept mounted on the cylinder 31 simply by switching the printing machine from the "plate making" mode to the "printing-on" mode. In the "printing-on" mode, the wetting roller 38, inking roller 39, blanket roller 40 and pressure roller 42 are set ready for operation while the ink jet recording head 34, ultraviolet lamp 37 and cleaning roller 43 are deactivated. The printing process of this printing machine can be executed substantially as illustrated in FIGS. 5*a* to 5*d*.

Upon completion of the printing process, the printing plate 33 is removed from the printing machine, and the printing machine is set to the "printing-off" mode in which the cylinder 31 and blanket roller 40 are cleaned. Upon completion of this cleaning step, a new blank printing plate is mounted on the printing machines to place the printing machine ready for the next "plate making" mode.

This printing machine allows the plate making and printing to be executed by using the same machine, and can reduce the overall cost of plate making and printing while the size of the overall system can be minimized. Because the printing plate is not required to be removed or mounted on the printer once again during the entire course of plate making and printing, the registration of the printing plate is not required. When the imaging resin consists of thermosetting resin instead of the ultraviolet curing resin, the printing plate can be handled under natural light without damaging the printing plate, and the handling and storing of the printing plates are simplified.

Figure 8:
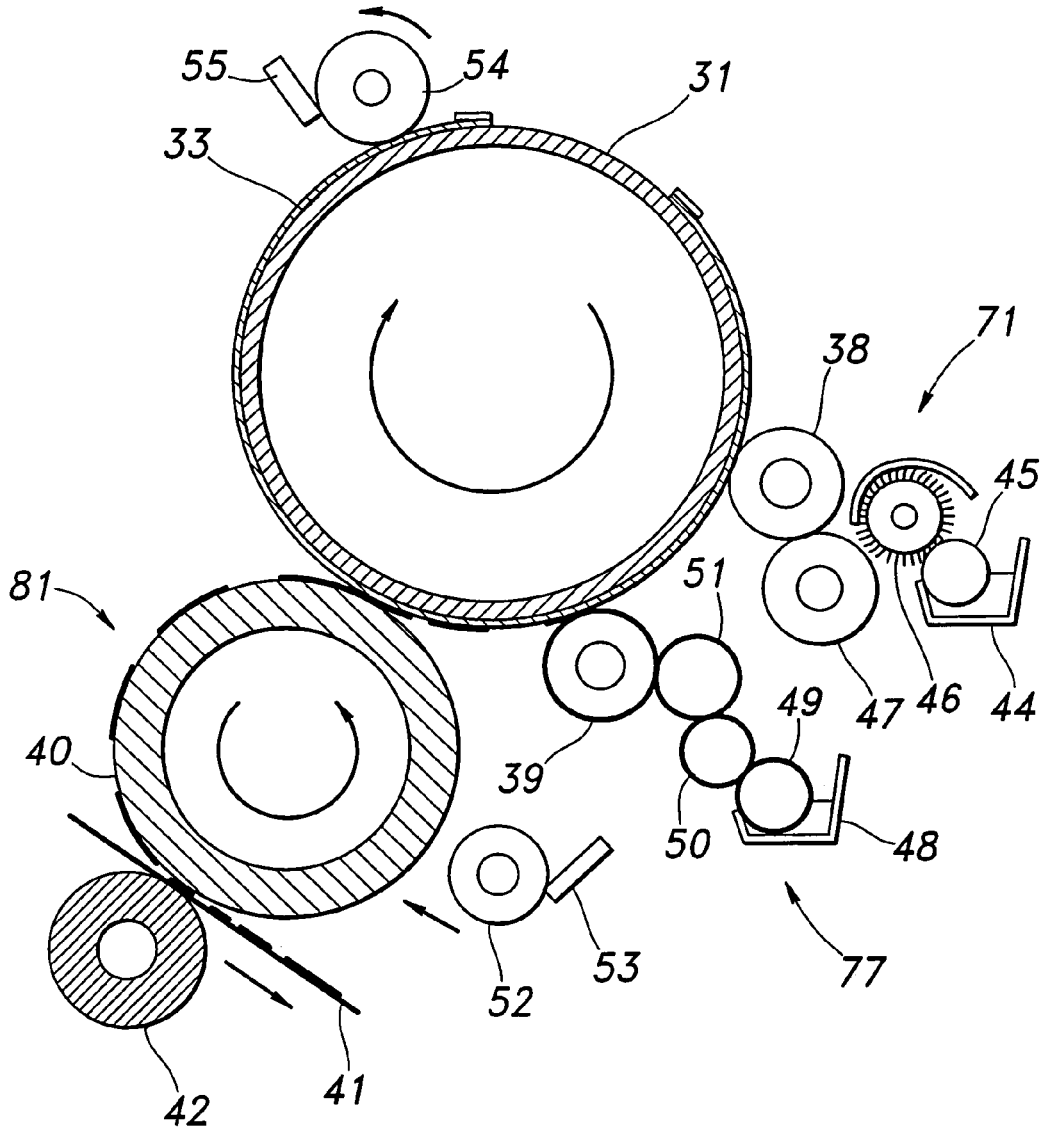
FIG. 8 is a simplified sectional view showing the wetting unit, inking unit and transferring unit of the printing machine illustrated in FIG. 7.

FIG. 8 is a simplified sectional view of the printing machine illustrated in FIG. 7 showing the wetting unit, inking unit and transfer unit of the printing machine. The wetting unit 71 for supplying wetting moisture to the printing plate 33 via the wetting roller 38 comprises a water bath 44 receiving wetting moisture therein, a water feed roller 45 partly dipped in the water bath 44, a brush roller 46 for splashing the wetting moisture received from the water feeding roller 45 by using spiral bristles provided on the brush roller 46, and a chromium roller 47 for receiving the wetting moisture from the brush roller 45 to form a uniform thin film of water on the surface thereof. The chromium roller 47 supplies a suitable amount of wetting moisture to the wetting roller 38.

The inking unit 77 comprises, in addition to the inking roller 39 for supplying printing oil ink onto the printing plate 33, an ink pot 48 storing the printing oil ink, a fountain roller 49 partly dipped in the ink of the ink pot 48, a pickup roller 50 for receiving the ink from the fountain roller 49, and a kneading roller 51 for kneading the ink in cooperation with the pickup roller 50. The kneading cylinder 51 ensures that a suitable amount of ink is supplied to the inking roller 39.

The transfer unit 81 transfers the image formed on the printing plate 33 by the printing oil ink onto the printing paper 41 or the like, and comprises a blanket roller 40 having a resilient surface for transferring the image on the printing plate 33 mounted on the cylinder 31 thereon, and then onto the printing paper 41 in cooperation with the pressure roller 42 supporting the printing paper from the back.

A cleaning roller 52 engages the blanket roller 40 to remove foreign matters such as printing ink, paper powder and moisture from the surface of the blanket roller 40, and the foreign matters collected by the cleaning roller 52 is removed by a blade 53 so as not to soil the blanket roller 40. Similarly, another cleaning roller 54 engages the cylinder 41 to clean the surface of the cylinder 41 (cleaning and wiping). The ink or other foreign matters collected on the cleaning roller 54 is removed by a blade 55 so as not to soil the cylinder 31.

Although the present invention has been described in terms of preferred embodiments thereof, it is obvious to a person skilled in the art that various alterations and modifications are possible without departing from the scope of the present invention which is set forth in the appended claims.

The invention claimed is:

1. A printing plate comprising:

a substrate; and a hydrophilic porous layer provided on a surface of said substrate, the hydrophilic porous layer including a plurality of small pits, imaging resin being deposited on selected parts of the surface of the hydrophilic porous layer, wherein an average diameter of said small pits and a thickness of said hydrophilic porous layer are configured to allow the imaging resin to be deposited thereon with a required bonding strength and with a required thickness, and wherein the thickness of said porous layer is no less than five times the average diameter of said pits.

2. The printing plate according to claim 1, wherein the plurality of small pits has an average diameter substantially not more than one tenth of a diameter of a dot that is to be formed by the imaging resin deposited on the surface of said hydrophilic porous layer.

3. The printing plate according to claim 1, wherein the plurality of small pits has an average diameter of 0.03 μm to 1 μm.

4. The printing plate according to claim 3, wherein the plurality of small pits have an average depth of 5 μm to 10 μm.

5. The printing plate according to claim 1, wherein said substrate comprises an aluminum base plate.

6. The printing plate according to claim 1, wherein said hydrophilic porous layer consists of an anodized layer, said anodized layer being 0.1 μm or more in thickness.

7. The printing plate according to claim 6, wherein said small pits are arranged at a density of $10\times10^6$ to $100\times10^6/mm^2$.

8. The printing plate according to claim 1, wherein said hydrophilic porous layer comprises an electrochemically etched layer.

9. The printing plate according to claim 8, wherein said small pits are arranged at a density in the order of $1\times10^6/mm^2$.

10. The printing plate according to claim 1, wherein said substrate comprises a plastic film, and an aluminum film laminated to a surface of the plastic film.

11. The printing plate according to claim 10, wherein said hydrophilic porous layer consists of an anodized layer, said anodized layer being 0.1 μm or more in thickness.

12. The printing plate according to claim 10, wherein said hydrophilic porous layer comprises an electrochemically etched layer.

13. The printing plate according to claim 1, further comprising a hydrophilic coating on the surface of said hydrophilic porous layer.

14. A printing plate comprising a substrate; and a hydrophilic porous layer provided on a surface of said substrate, the hydrophilic porous layer including a plurality of small pits, imaging resin being deposited on selected parts of the surface of the hydrophilic porous layer, and wherein the plurality of small pits has an average diameter substantially smaller than a diameter of a dot that is to be formed by the imaging resin deposited on the surface of said porous layer.

15. The method for making a printing plate according to claim 14, wherein an average spacing between adjacent small pits is smaller than a representative size of a dot or line of imaging resin deposited on the hydrophilic porous layer.

16. A printing plate comprising:

a substrate; and a hydrophilic porous layer provided on a surface of said substrate, the hydrophilic porous layer including a plurality of small pits, imaging resin being deposited on selected parts of the surface of the hydrophilic porous layer, wherein the plurality of small pits has an average diameter substantially smaller than an average diameter of particles of an oil-based printing ink.

17. The printing plate comprising:

a substrate; and a hydrophilic porous layer provided on a surface of said substrate, the hydrophilic porous layer including a plurality of small pits, imaging resin being deposited on selected parts of the surface of the hydrophilic porous layer, wherein said small pits extend substantially perpendicularly to a major plane of said printing plate and are spaced from one another.

18. The printing plate according to claim 17, wherein said hydrophilic porous layer including the plurality of small pits is configured by an anodic oxidation process or by electrochemical etching.

19. A method for making a printing plate comprising:

preparing a blank printing plate including a substrate and a hydrophilic porous layer provided on a surface of the substrate, the hydrophilic porous layer including a plurality of small pits;

applying imaging resin in a substantially liquid form on selected parts of the surface of the hydrophilic porous layer;

curing the imaging resin applied to the hydrophilic porous layer; and applying the imaging resin by an ink jet recording head, wherein the plurality of small pits has an average diameter substantially smaller than a dot formed by the imaging resin applied by the ink jet recording head.

20. The method for making a printing plate according to claim 19, wherein the imaging resin comprises an ultraviolet curing resin, and the curing comprises radiating ultraviolet energy onto the imaging resin.

21. The method for making a printing plate according to claim 19, wherein the imaging resin comprises a thermosetting resin, and said curing comprises applying heat to the imaging resin.

22. The method for making a printing plate according to claim 19, wherein the imaging resin is lipophilic.

23. The method for making a printing plate according to claim 19, wherein the imaging resin in liquid form has a viscosity in the range of 5 cp to 30 cp at room temperature.

24. The method for making a printing plate according to claim 19, wherein the imaging resin in liquid form contains 10% weight or less of solvent.

25. The method for making a printing plate according to claim 19, preparing the blank printing plate further comprising electrolytically polishing a surface of a plate member essentially made of aluminum, and anodizing the surface thereof.

26. The method for making a printing plate according to claim 19, preparing the blank printing plate further comprising electrolytically polishing a surface of a plate member essentially made of aluminum, and electrochemically etching the surface thereof.

27. The method for making a printing plate according to claim 19, preparing the blank printing plate further comprising laminating an aluminum layer on a surface of a plastic film, and electrochemically etching the aluminum layer.

28. The method for making a printing plate according to claim 19, wherein an average spacing between adjacent small pits is 2 to 3 μm.

29. The method for making a printing plate according to claim 19, wherein an average spacing between adjacent small pits is smaller than a representative size of a dot or line of imaging resin applied on the hydrophilic porous layer.

* * * * *

UNITED STATES PATENT AND TRADEMARK OFFICE

CERTIFICATE OF CORRECTION

PATENT NO. : 7,063,017 B2
APPLICATION NO. : 10/725529
DATED : June 20, 2006
INVENTOR(S) : Ohigashi et al.

It is certified that error appears in the above-identified patent and that said Letters Patent is hereby corrected as shown below:

At column 14, line 54 (claim 15, line 1) of the printed patent, "The method for making a printing" should be --The printing--.

Signed and Sealed this

Eighteenth Day of December, 2007

JON W. DUDAS
*Director of the United States Patent and Trademark Office*